US006119699A

United States Patent [19]

Sung

[11] Patent Number: 6,119,699

[45] **Date of Patent: *Sep. 19, 2000**

[54] METHOD AND APPARATUS FOR THE SELECTIVE REMOVAL OF SPECIFIC COMPONENTS FROM SMOKE CONDENSATES

[76] Inventor: Michael T. Sung, 1604 Reston Ct., Raleigh, N.C. 27614

[ * ] Notice: This patent issued on a continued prosecution application filed under 37 CFR 1.53(d), and is subject to the twenty year patent term provisions of 35 U.S.C. 154(a)(2).

[21] Appl. No.: 08/995,217

[22] Filed: Dec. 19, 1997

[51] Int. Cl.[7] ..... A24D 1/04; A24F 7/04; A24F 13/06

[52] U.S. Cl. ..... 131/202; 131/200; 131/201; 131/203; 131/334; 131/340; 131/341; 131/331; 131/342

[58] Field of Search ..... 131/334, 340, 131/341, 331, 200, 201, 202, 203, 342

[56] References Cited

U.S. PATENT DOCUMENTS

| | | | |
|---|---|---|---|
| 1,808,707 | 6/1931 | Wiggins . | |
| 1,826,331 | 10/1931 | Traube . | |
| 2,325,386 | 7/1943 | Frank . | |
| 2,739,598 | 3/1956 | Eirich . | |
| 2,754,829 | 7/1956 | Hess . | |
| 2,815,760 | 12/1957 | Schreus et al. . | |
| 2,834,354 | 5/1958 | Rosenberg . | |
| 2,872,928 | 2/1959 | Ross . | |
| 2,920,629 | 1/1960 | Kinnavy . | |
| 2,920,630 | 1/1960 | Kinnavy . | |
| 2,956,329 | 10/1960 | Touey . | |
| 2,966,157 | 12/1960 | Touey et al. . | |
| 2,968,305 | 1/1961 | Barnett . | |
| 3,033,212 | 5/1962 | Touey et al. . | |
| 3,093,144 | 6/1963 | van Buuren . | |
| 3,105,500 | 10/1963 | Wilson | 131/334 |
| 3,120,849 | 2/1964 | Guttag . | |
| 3,291,140 | 12/1966 | Burke et al. | 131/334 |
| 3,319,635 | 5/1967 | Stahly | 131/334 |
| 3,472,238 | 10/1969 | Blount et al. . | |
| 3,650,278 | 3/1972 | Cook . | |
| 3,777,765 | 12/1973 | Yoshinaga . | |
| 3,828,800 | 8/1974 | Litzinger . | |
| 3,943,940 | 3/1976 | Minami . | |
| 3,984,349 | 10/1976 | Meiller et al. . | |
| 4,002,177 | 1/1977 | Rainer et al. . | |
| 4,006,749 | 2/1977 | Horowitz et al. . | |

(List continued on next page.)

OTHER PUBLICATIONS

Perry, Robert H; Perry's Chemical Engineers' Handbook, 6th edition, McGraw–Hill Inc, 1984.

Mumpower, R.C. et al., "Some Factors That Affect the Filtration of Nicotine From Cigarette Smoke," *Tobacco Science,* pp. 14–17, 1967.

Alvord, E.T. et al., "The Inhibition of Formation of 3,4–Benzpyrene in Cigarette Smoke," *British Journal of Cancer,* pp. 498–503, 1956.

Morie, G.P., *Selective Filtration of Tobacco Smoke Components: A Review,* pp. 552–583, 1977.

Reynolds, M.L., "Influence of Filter Additives on Smoke Composition," *Recent Advances in Tobacco Science,* vol. 8:3, pp. 47–67, 1978.

*Primary Examiner*—Christopher A. Fiorilla
*Attorney, Agent, or Firm*—Oliff & Berridge, PLC

[57] ABSTRACT

A smoking article capable of delivering a regulated smoke composition to a smoker, includes: a) a combustible filler wrapped in a combustible sheath; and b) at least one affinity chromatographic filter unit designed to preferentially remove specific targeted components from the smoke disposed within the sheath adjacent the combustible filler. The filter unit includes a mass of silica or resin particles having chemically bonded to their surfaces functional groups which exhibit preferential affinity for the targeted components and which reversibly bind the targeted components to elute components having a lower affinity than a previously bound component.

36 Claims, 3 Drawing Sheets

U.S. PATENT DOCUMENTS

| | | | |
|---|---|---|---|
| 4,033,361 | 7/1977 | Horsewell et al. | 131/334 |
| 4,038,470 | 7/1977 | Stehlicek et al. . | |
| 4,038,992 | 8/1977 | Ogasa et al. . | |
| 4,156,431 | 5/1979 | Epstein et al. . | |
| 4,182,743 | 1/1980 | Rainer et al. . | |
| 4,193,412 | 3/1980 | Heim et al. . | |
| 4,201,234 | 5/1980 | Neukomm | 131/265 |
| 4,202,356 | 5/1980 | Digenis et al. . | |
| 4,300,577 | 11/1981 | Horsewell et al. | 131/334 |
| 4,318,417 | 3/1982 | Hiroshi et al. | 131/274 |
| 4,324,681 | 4/1982 | House . | |
| 4,372,328 | 2/1983 | Kausch et al. . | |
| 4,387,017 | 6/1983 | McEntire et al. . | |
| 4,512,897 | 4/1985 | Crowder, III et al. . | |
| 4,532,947 | 8/1985 | Caseley | 131/331 |
| 4,623,638 | 11/1986 | Hayatsu et al. . | |
| 4,700,723 | 10/1987 | Yoshikawa et al. . | |
| 5,212,131 | 5/1993 | Belding . | |
| 5,383,478 | 1/1995 | Rose et al. . | |
| 5,465,739 | 11/1995 | Perfetti et al. . | |
| 5,524,629 | 6/1996 | Mahony . | |
| 5,524,647 | 6/1996 | Brackmann . | |
| 5,617,882 | 4/1997 | Bushuev et al. . | |

METHOD AND APPARATUS FOR THE SELECTIVE REMOVAL OF SPECIFIC COMPONENTS FROM SMOKE CONDENSATES

FIELD OF THE INVENTION

This invention relates, in general, to a chemical process and apparatus for the selective reduction of specific tar components of smoke generated by smoking articles such as cigarettes. More particularly, the present invention relates to the use of functionalized resin particles having a specific affinity for a targeted smoke component, such as tar, as a filter to selectively remove such component without coordinately removing desired nicotine and flavor components.

DESCRIPTION OF THE RELATED ART

The control of tar and nicotine in cigarette smoke is largely attributed to the use of filters which physically remove total particulate matter (TPM) from the mainstream smoke condensate. Thus, the grades of "full flavor", "light", and "ultralight" cigarettes are based on the effectiveness of their filters to eliminate the potential tar and nicotine as found in normal unfiltered cigarettes. This classification system relates to the Federal Trade Commission's (FTC) restrictions on the amount of "tar" the cigarettes may deliver to a smoker. A "full flavor" cigarette delivers 14 mg or more of tar; a "light" cigarette delivers between 8 and 14 mg of tar; and an "ultralight" cigarette delivers less than 7 mg of tar. The "ultralight" cigarette also has an air dilution filter tip to further reduce the tar in the mainstream smoke.

The latest technology is a "heat" cigarette, available from R. J. Reynolds under the trade designation "Eclipse" which employs a carbon core in the cigarette. Unlike traditional cigarettes, this new cigarette does not burn at 800° C. but instead heats the tobacco to less than 300° C. This low temperature avoids combustion which reduces tar formation and also the distillation of nicotine. The cigarette produces low levels of tar and nicotine in both the main and sidestream smoke. Toxicological and biological studies performed by Reynolds Tobacco Company have demonstrated that it is a safe smoking article. However, this cigarette does require some adjustment from the smoker.

In addition, numerous filter elements are disclosed in the art to be useful in reducing the levels of tar delivered to a smoker. For example, numerous patents exist describing filter elements that employ baffles and orifices to reduce tar and nicotine. U.S. Pat. No. 3,777,765 to Yoshinga discloses a filter apparatus consisting of a chamber for depositing smoke condensates. The smoke micelles route through this chamber and then exit through another porous barrier disk to become the mainstream smoke. U.S. Pat. No. 3,650,278 to Cook describes an adjustable tar removing filter for cigarettes having an adjustable needle valve that the smoker adjusts to the desired level of taste. U.S. Pat. No. 3,472,238 to Blount et al. describes yet another cigarette holder device with a disposable tar collecting cartridge. U.S. Pat. No. 5,617,882 to Bushuev et al describes a filter unit containing both organic and inorganic basalt fibers which it claims provides better tar trapping effectiveness than conventional filters.

Further, examples of liquids for chemical reaction in a filter are known. U.S. Pat. No. 3,943,940 to Minami proposes a chemical process in the smoking filter to remove nicotine from the smoke. An aqueous solution of potassium permanganate ($KMnO_4$) and chlorine is impregnated in the filter. Because the aqueous $KMnO_4$ solution is unstable, chlorine is added as a stabilizer. It is not clear to what extent permanganate contributes to the oxidation of nicotine since the water barrier filter is also removing nicotine from the smoke.

The potential of activated silica resin as a smoke adsorbent is also suggested in the art. For example, the use of activated silica in cigarette filters is disclosed in U.S. Pat. Nos. 1,808,707, 1,826,331 and 2,325,386. However, all of these patents describe a loose distribution of the resin particles in the filter proper for removing smoke condensates, and the results are not dramatic. U.S. Pat. No. 2,956,329 to Touey describes the manufacturing of a filamentous acetate filter containing up to 35.5% of silica gel, and reports the effective removal of 34% of the acetaldehyde from the smoke stream. U.S. Pat. No. 2,968,305 and British Pat. No. 795,420 to Barnett discloses a chamber and smoke labyrinth construction in a cigarette filter element for the placement of silica granules. Further, U.S. Pat. Nos. 2,834,354 and 2,872,928 both suggest that by incorporating silica gel bearing either deoxycholate or partially polymerized furfural into the cigarette filter it should be possible to remove heavy hydrocarbons such as benzopyrene from the smoke. However, in "Influence of Filter Additives on Smoke Composition" by M. L. Reynolds, *Recent Advances in Tobacco Science,* Vol. 4, pp. 47–67, 1978, it is discussed that the removal of polycyclic aromatic hydrocarbons (PAH) has been claimed in many patents, but has never been demonstrated to be successful.

Additionally, the use of ion exchange resins in filter elements has been suggested in the art. For example U.S. Pat. No. 2,739,598 to Eirich describes the manufacture of a copolymer of methyl acrylate and vinyl pyrrolidone as both anion and cation exchanger by embedding the polymers in a paper pulp. The impregnated paper is used as a cigarette filter to remove those ionic species from smoke. U.S. Pat. Nos. 2,754,829 and 2,815,760 to Hess disclose the use of cationic exchangers, and U.S. Pat. No. 3,093,144 to van Bururen discloses the use of both anionic and cationic resins to remove nicotine from tobacco smoke. U.S. Pat. No. 4,700,723 to Yoshikawa and Shimamura also discloses a fibrous ion-exchange resin that can be incorporated into a cigarette filter. However, their approach is one dimensional. The gas chromatograms of the smoke condensate following the resin treatment appear to show only a quantitative reduction of tar and nicotine. There is no consideration of specificity and the disclosure does not address specific trapping of targeted components.

In U.S. Pat. Nos. 2,920,629 and 2,920,630 to Kinnavy, a special cotton filter that is impregnated with a waxy salt of trimethyloctadecylammonium chloride (or a class of long chain alkyl-quaternary ammonium chloride) and sodium sterate is disclosed as being useful as a cigarette filter. The input is roughly 1 gm per 2 gm of cotton. When this is used as a tobacco smoke filter, it drastically reduces both tar and nicotine. The high input of a waxy substance with cotton fiber apparently creates a sticky, fatty, and oily filter that obliterates the potential of the long chain hydrocarbon to be capable of specific interactions with smoke components. Instead, it is made into a sticky filter pad for the nonspecific removal of tar and nicotine. U.S. Pat. No. 3,033,212 to Touey and Kiefer discloses a similar intent of incorporating a waxy sterate into a cellulose filter to prevent smoke condensates from being dislodged from the cigarette filter after entrapment.

In the advent of ultra low tar cigarettes, there is a need to increase flavor and nicotine while decreasing tar. U.S. Pat. No. 5,524,647 to Brackmann discloses using the upper portion of the tobacco plant to provide a higher than normal flavor to tar ratio. In addition, a cylinder of microfine filter element is used to reduce tar and nicotine. This biological approach tends to increase flavor and nicotine relative to tar levels.

U.S. Pat. No. 5,465,739 to Perfetti et al describe the incorporation of acids and bases into the filter elements to influence the nicotine content of tobacco in the mainstream smoke. Acid is used for removing more nicotine in the tobacco blends which has high nicotine content and base for those tobacco blends with low nicotine. The intent is for normalizing the tobacco blends to achieve a consistent product.

Recently increasing pressure to reduce cigarette tar has reached an all time high. The industry has responded by increasing the efficiency of filters to decrease tar and nicotine. Nevertheless, many smokers demand even further reductions in tar. However, the ability of existing cigarette design technology to respond to that demand, while still providing flavor, is limited. Conventional methods generally achieve a coordinated reduction of tar and nicotine from the mainstream smoke. The resultant "ultralight" cigarette may not be as flavorful. Consequently, a frustrated smoker may choose to smoke more cigarettes, or alter the filters in a number of ways. All of these known practices defeat the intent of reducing the tar and nicotine in the cigarette smoke. Moreover, because the delivery of tar and nicotine is highly dependent on the manner of smoking, issues of cigarette labeling and testing are being raised with manufacturers by the FTC. Clearly, there is a need for a new approach to control tar and nicotine in the mainstream smoke. This need is met by the invention disclosed herein. The invention represents a drastic departure from conventional cigarette filter design and engineering, and provides a filter capable of selectively removing tar, or virtually any other component, without coordinately removing other components, such as nicotine, below desired levels.

SUMMARY OF THE INVENTION

The present invention represents a new approach in the control of tar and nicotine in cigarette smoke. Although the separation of molecules according to affinity is a well-known chemical principle, the selective separation and removal of cigarette smoke constituents on a solid phase resin has not previously been effectively accomplished. Cigarette smoke condensate is both aqueous and organic, and is amenable to the characteristics of gas and liquid chromatography. However, it differs from traditional chromatography because the parameters have more constraints. For example, the puff composition, unlike the carrier gas or mobile phase of traditional chromatography, is not homogenous. Further, the time of flight of the smoke composition over the resin surface with each puff is very short. The total number of puffs per cigarette is also limited. Additionally, the binding affinity of the smoke components to the resin may involve complex interactions. In the first puff, the resin surface is unoccupied and therefore smoke components possessing both weak and strong interactions may have equal probability of landing on available binding sites. As smoking is continued, potential sites gradually disappear, and stronger binding molecules generated by each new puff begin to compete with all other existing molecules on the resin. The competition favors those that are specific and with high affinity and therefore the weaker binding components begin to be displaced by stronger binding molecules.

The present invention embodies the control of tar and nicotine via the incorporation of one or more resins with diverse functional groups which regulate the composition of the mainstream smoke as it exits the cigarette. In particular, the invention provides an improved use of silica, in the form of functionalized silica resins having a high capacity bonded phase for the selective removal of specific classes of tar components to achieve a desired balance in a cigarette that is still full of aroma and flavor, yet offers slightly more nicotine than unwanted tar to satisfy a smoker. Additionally, the present invention alleviates concerns that smokers can defeat the beneficial attributes of reduced tar by the manner in which they smoke. Because the affinity binding of the targeted smoke component to the resin is practically irreversible, the present invention generates a mainstream smoke that is true to the intended label. The smoker can no longer change the manner of smoking to effect the composition of the mainstream smoke.

The present invention thus has multifaceted attributes, including the ability of resins with distinctive characteristics to be designed to bring about adsorption of only that population of tar components with such specificity. As a result, nicotine and tar can be regulated independently through the use of high capacity bonded phase silica resins. For example, a silica resin functionalized with a broad spectrum bonded phase, such as an eighteen carbon (C-18) aliphatic hydrocarbon, a catch-all resin, is uniquely suited for the removal of aliphatics and hydrocarbons from smoke, yet allows some polar flavor components to be delivered to the smoker. The C-18 bonded silica filter provides a reduction of the volatile and semivolatile smoke components equal to the standard of clean smoke generated by the no bum cigarette known as Eclipse, while maintaining an acceptable level of nicotine. The process is simple, safe, and efficacious. Since no chemical is added to the tobacco rod, no new chemical species are generated.

Additionally, the present invention provides cigarettes capable of delivering an artificial flavor, e.g., menthol, into the smoke by incorporating the flavoring into the resin particles such that they are removed in a "reverse mode" by smoke constituents exhibiting greater affinity for the functional groups on the resin particles. Consequently, the new generation of cigarettes with desired advantages can even deliver menthol flavor continuously with every puff and even to the last puff.

BRIEF DESCRIPTION OF THE DRAWINGS AND TABLES

FIG. 1 depicts chromatograms of the mainstream vapor-phase smoke of various cigarettes collected in a methanol trap: the top panel is smoke from a cigarette treated with a combination of resins consisting of: 50 mg silica (100 μm and 60 Å), 100 mg C-18 resin (100 μm and 60 Å), 100 mg of C-18 resin (200 μm and 60 Å) and 100 mg 3-aminopropyl resin (200 μm and 60 Å); the bottom panel is the Eclipse regular flavor and the middle panel is the control Marlboro with the acetate filter removed.

FIG. 2 shows chromatograms of the mainstream vapor-phase smoke collected in methanol trap for cigarettes treated with various resin combinations of C-18, amino, and silica resins. From top to bottom: (1) Control of FIG. 1 (middle panel) diluted 1:4; (2) Resin 50/300 consisting of :50 mg 3 aminopropyl resin (100 μm and 60 Å) and 300 mg of C-18 resin (200 μm and 60 Å); and (3) 150 mg of C-18 resin (100 μm and 60 Å).

FIG. 3 illustrates the utility of the affinity C-1 resin in delivering menthol in the mainstream smoke.

DETAILED DESCRIPTION OF THE PREFERRED EMBODIMENTS

Figure 1A:
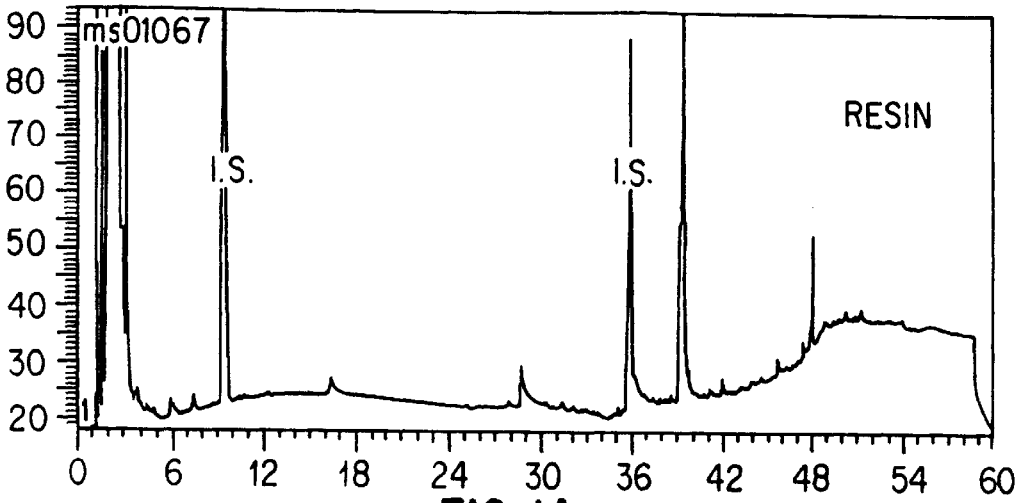

The present invention provides a novel application of the principles of affinity chromatography in the design of cigarette filtration media to permit the planning and development of filter elements that selectively remove a class of targeted components of the smoke. The filter elements are comprised of functionalized resin particles wherein the ligands exhibit the desired specific affinities for the targeted component molecules. Useful resin particles include materials that are rigid, chemically stable, nontoxic and with very large resin surface areas which can be derivitized to permit the design and construction of useful functional groups. Suitable resins include methacrylate, and styrene, styrene divinylbenzene. Silica can also be used. However, silica is generally preferred because of its rigidity and its avoidance of swelling and shrinking over a broad range of humidity conditions.

The resin particles preferably have a particle size of from about 35 to 400 microns, and are preferably spherical or irregularly shaped and of high porosity. Non-porous resins are generally not preferred because they create draw resistance and have a reduced available surface area for the bonding of ligands.

The performance of the affinity resin is dependent upon its size, porosity and functional group capacity, which can be varied to maximize the efficiency or the specificity of the resulting filter. The efficiency of an affinity resin is measured by its ability to remove tar and nicotine from the smoke condensate. In general, the smaller the resin particle, the more efficient the resin. Spherical or irregular particulates create a resin filter column wherein the beads are stacking and overlapping. The interbead spacing of 40–60 $\mu$m resin is only ~20–30 $\mu$m. This narrow and convoluted passage-way ensures the collision and adsorption of smoke micelles. Consequently, particles of such size provide a resin filter that is generally nonspecific, but which is highly efficient in removing tar and nicotine from the smoke condensate. However, the particle size and porosity is preferably selected so as not to increase pressure drop which increases draw resistance during smoking.

In general, specificity varies directly as the parameters of resin particle size, pore size, and resin capacity. The most selective resin therefore would generally have a large particle size (e.g., about 200 $\mu$m) a high porosity (e.g., about 1000 Å) and a high ligand loading capacity (e.g., at least about 1 milliequivalence per gram of resin). However, such a resin may be too fragile due to the thin walls created by the large pores in the particles. Accordingly, it is generally preferred that the selected resin be spherical or irregular particles having an average diameter of from about 35 to 400 microns, more preferably from 75 to 200 microns, and an average pore size ranging from about 60 to 1000 angstroms, more preferably from about 300 to 1000 angstroms. Additionally, the shape and size of the resin particles should be selected so as to enhance the interbead spacing to allow free flow of the smoke micelles.

To achieve a balance of efficiency and specificity, a preferred embodiment of the resin filter may employ a multicomponent resin cartridge. The first resin cartridge component preferably comprises a column from about 2–4 millimeters of a fine resin having an average particle diameter of from about 50 to 70 $\mu$m with a high porosity of from about 300 to 1000 Å to result in the gross reduction of tar and nicotine. The first component cartridge is preferably followed by a second component cartridge comprising a column of from about 5 to 10 millimeters in length of a relatively large bead resin, having an average particle diameter of from about 150 to 200 $\mu$m, with large pore size of at least about 300 Å and a high capacity loading of functionality for specificity.

Alternatively, it is envisioned that a honey combed, filigree-like, or even fiberous construction of nonparticulate materials bearing functional groups may be used as a substitute. The ultimate criteria is to achieve a high capacity of ligand bonding of at least 0.6 millimoles per gram of material.

The ligand attached to the resin beads are preferably selected to preferentially bond with the molecules targeted for removal from the smoke stream. Although the specific functional groups utilized may vary widely depending upon the targeted smoke component, selection of suitable functional groups are well within the purview of one skilled in the art based upon fundamental chemical principles. However, with regard to the generally desired reductions of tar, preferred functional groups that exhibit greater affinity for tar than for nicotine have been found to contain hydrocarbon groups of the general formula $R^1$—$(CH_2)_n$-where n is an integer from 1 to 40; and $R^1$ represents hydrogen, hydroxy, amine, amide, cyano, nitrate, nitro, thio, sulfide, sulfone, sulfoxide, I, Br, Cl, F or an alkyl or aryl organic substituent containing from about 1 to 40 carbon atoms, which may be straight or branched, saturated or unsaturated and optionally substituted with one or more substituents selected from O, N, S, or halides. For example, $R^1$ may be an alkyl group such as an alkane, alkene, alkyne, acid, alcohol, aldehyde, ester, ether, or ketone; or an aryl group such as a benzyl, naphthyl, anthryl, biphenyl, phenolic or heterocyclic group. Particularly useful functional groups have been found to be straight chain, alliphatic hydrocarbons of from 3 to 18 carbon atoms in length, with C-18 hydrocarbons, having been discovered to exhibit selectivity for a broad range of volatile organic smoke constituents in preference to nicotine. Additionally, aromatic functional groups such as benzene, naphthene and anthracene may be particularly useful in selectively removing volatile aromatic PAH components through chemical bonding known as $\pi$—$\pi$ interaction.

In the practice of the invention, cigarette filters are formed of the functionalized particles by encasing a desired volume of the particles behind the tobacco rod of a conventional cigarette. The encasement may be formed in part by the cigarette filter paper overwrap, or the resin particles may be encased in a separate vapor permeable membrane to form a cartridge that may be affixed to the end of the cigarette, or included within the paper shell. The resin filter cartridges may be used alone or in conjunction with conventional acetate filters. In such embodiments the resin filters may be conveniently located between the tobacco rod and the conventional acetate filter element. Additionally, multiple resin filter cartridges may be serially connected to the tobacco rod and used to effectuate the desired selective removal of targeted molecules. In this manner, filter cartridges containing particles of varying functionality, size, porosity, etc. can be connected serially to remove specified amounts of targeted components. Furthermore, particles having different functionalities, size, porosity, etc. can be combined into a single filter cartridge as desired.

Accordingly, the preferred smoking article of the invention has incorporated therein at least about 15 mg of functionalized 35–200 $\mu$m silica gel particles right behind the tobacco rod and placed uniformly before the final monoacetate filter. The synthesis of the functionalized resin is illustrated below in Example 1, however, modifications necessary for the attachment of other functional groups will be readily apparent to the skilled artisan. The smoking article may be any brand of commercially available cigarettes, either filtered or unfiltered.

The following examples are illustrative of the present invention. The specific ingredients and processing parameters are presented as being typical, and various modifications can be derived in view of the disclosures as presented within the scope of the invention. Example 1 describes the basic strategies in the resin design. Examples 2–4, describes the solid phase affinity chemistry. The initial challenge to differentiate between nicotine and tar is borne out by the observation that nicotine is not retained by the reverse phase column. A specificity index is used to quantitate the differentiation and also to compare data between different groups of experiments. The resin experiments are recorded in the history of the mainstream smoke components in its passage through the compartments of resin, monoacetate filter and then collected onto a Cambridge filter pad. By studying the inter-relationship of the compartments, the molecular anatomy and the intricacies as well as the dynamics of the affinity smoke chemistry unfold. Additional confirmation of selectivity can be found in the Examples of amino and phenyl resins. The subtitles of selectivity are often difficult to recognize. This is due to the complexities in molecular recognition. Often it involves many functionalities and each contribute only a small percentage to the overall selectivity. The examples given are designed to provide the tools necessary to solve these intricate problems. Capacity and particle size parameters which enhance selectivity are discussed in Example 4. Example 5 validates the puff affinity technology by creating a low or ultralow tar cigarette that burns rather than heats the tobacco and achieves a clean vapour phase composition which is comparable to the industry standard of Eclipse. Additionally, menthol cigarettes have been a commercial favorite, and Example 6 demonstrates the reverse mode of affinity resin utility for delivering this flavor.

EXAMPLE 1

Silica is a very desirable solid phase sorbent and comes in various sizes and shapes. It can be either porous or nonporous, spherical or irregular, and with particle sizes that range from the very fine of 5 $\mu$m to the bead size of 1200 $\mu$m. Porous silica resin is the preferred material for the synthesis of a universal affinity precursor resin which possesses amino functionality. The arm of the precursor resin contains a 3 amino-propyl group which may be lengthened by reacting with various acyl-chlorides. For example, reaction with acetyl-chloride yields a resin containing a 5 carbon chain length functional group. In addition, more carbon chains may be extended to the amino arm by using fatty acids of different chain lengths.

The synthesis of the precursor resin began with selecting activated and porous silica resins with a mean diameter of either 50 $\mu$m, 100 $\mu$m or 200 $\mu$m. The fines of the resins were progressively removed by sedimentation and decantation in water and the resins were finally washed in methanol. The resins were dried in an vacuum oven overnight at 100° C. These resins were then used to make the following functionalized resins as follows:

3-amino-propyl resin: 20 gm of the washed and defined resins were treated with 10 ml of 3-aminopropylsilane in 100 ml of toluene. The resins were refluxed overnight to allow maximum incorporation of the propyl-amino group. The following day, the solvents were decanted and the resins were washed with 100 ml of toluene followed by three washes of methanol in a scintered disk funnel. The resins were thoroughly dried in a vacuum oven, and the capacity of the resin was determined by acid base titration. For the 200 $\mu$m resin, it was about 0.8 millimoles per gm; for the 60–120 $\mu$m resin, it was about 0.6 millimoles and the 40–60 $\mu$m resin was about 0.5 millimoles. These levels are at least about 10 times more than the capacity of resins typically used for High Pressure Liquid Chromatography (HPLC) applications, and they approach that of the ion-exchanger for deionizing water. In addition, the resin amino groups may be visualized by staining with ninhydrin and their lack of staining for the following resins.

C-1 resin: 2 gm of the washed and defined resins was treated with approximately 3 ml of chlorotrimethylsilane in 20 ml of toluene and refluxed for 2 hours. Following reaction, the C-1 resin was washed with toluene and followed by three washes with methanol and then dried.

C 5 or C 7 resin: Acetyl chloride or succinyl chloride was synthesized by reacting 5 ml of 2 M thionyl chloride in 10 ml of toluene with acetic acid or succinic acid. The acid chlorides were further purified by distillation. 2 gm of the 3-amino-propyl resin was then incubated overnight with the fresh acetyl chloride or succinyl chloride in pyridine. The next day, the resin was washed with methanol and dried.

Phenyl resin: Benzoyl chloride was synthesized by refluxing 5 ml of 2 M thionyl chloride in 10 ml of toluene with benzoic acid for 30 minutes. The residual thionyl chloride and toluene were removed by distillation. 2 gm of the 3-amino-propyl resin was then incubated at room temperature overnight with the fresh benzoyl chloride in pyridine. The next day, the resin was washed with methanol and dried.

C 18 resin: Pentadecanoyl chloride was synthesized by reacting 10 ml of 2 M thionyl chloride in 10 ml of toluene with 1.5 gm pentadecanoic acid. After 40 minutes of refluxing, the remaining thionyl chloride and toluene were removed by distillation. 4 gm of the 3-amino-propyl resin was then incubated overnight with the freshly prepared pentadecanoyl chloride in pyridine. The next day, the resin was twice washed with methylene chloride and then three times more with methanol and dried.

EXAMPLE 2

Chromatography of nicotine on C8 or C4 HPLC column under reverse phase condition showed that it was eluted in the void volume and was not retained by the column. This is due to the fact that nicotine is positively charged in an aqueous pH environment and does not bind to a resin which is specific for aliphatic carbon interaction. This fact makes it plausible to test if the nicotine present in the smoke condensate also behaves in the same manner. More specifically, the test may be conducted with C5 or C7 resins as manufactured under Example 1 in a "cigarette column." The resins used had an average particle size of 100 $\mu$m and a pore size of 60 angstroms. Table 1 shows the results of the experiments. The resins were placed between the filter and the tobacco rod of a conventional cigarette, and the cigarette was tested on a smoking machine. The control and resin treated cigarettes were smoked under standard FTC conditions. The puffing regimen consisted of 35±0.5 ml puff volume, a puff duration of 2 seconds and a puff frequency of 1 puff per 60 seconds. In measuring the semivolatiles of the cold trap experiments, the cigarettes were smoked to 12 mm from the overwrap. Smoke collection onto the Cambridge filter pad were extracted with 2-propanol. The determination of nicotine and propylene glycol was by capillary gas chromatography employing a HP5890 GC equipped with a 30 meter megabore carbowax column and flame ionization detector (FID). The semivolatiles were collected in an isopropanol cold trap maintained by dry ice at −70° C. and determined on a 30 meter DB624 capillary column equipped with a precolumn and also by FID detection. In the resin treated cigarette, the monoacetate filter was dislodged and removed from a commercial cigarette. The resins were weighed and placed right behind the tobacco rod from the open butt end of the cigarette. To insure even placement of the resin, the cigarette was kept in a vertical position, gently tapped, and a new and intact monoacetate filter reinserted. This experiment examined specific interactions between the smoke condensate and the resin. Therefore, the nonspecific trapping of smoke condensate was reduced in part by removing all the fines in the resins. The values of tar, nicotine, and propylene glycol, were all derived from the Cambridge filters.

Initially, the reduction of nicotine was compared to that of tar, however, any change in nicotine as a ratio to tar is insensitive because tar is at least ten times larger. In addition, tar is a poorly defined complex entity and its determination is not highly quantitative. The comparison should be to a specific indicator component of the tar such that both chemicals can be accurately determined. Propylene glycol is a suitable indicator since it is also a major component of the tar. However, it is chemically distinct from nicotine; that of a glycol versus an alkaloid. Both chemicals are slightly polar and yet both are soluble in organic solvents. In Table 1, the relative retention of nicotine by the two resins is compared to propylene glycol. In the control cigarette there is a basal ratio of nicotine to tar and it is 2.16. If the resin removes more propylene glycol than nicotine, this ratio will also increase proportionately. Therefore, by expressing the ratio of increase due to resin as a percentage of the control, a normalized quantitative comparison is achieved. This is defined as the specificity index.

TABLE 1

SPECIFICITY INDEX

| | Tar mg | Nicotine mg | Propylene Glycol mg | Ratio Nic/PG | % of Control - Specificity Index |
|---|---|---|---|---|---|
| Control | 12.54 | 0.8405 | 0.388 | 2.16 | 100% |
| Succinyl | | | | | |
| C 7-30 mg | 9.31 | 0.6062 | 0.200 | 3.03 | 140% |
| C 7-45 mg | 7.80 | 0.5057 | 0.181 | 2.79 | 129% |
| C 7-45 mg | 7.24 | 0.4220 | 0.162 | 2.60 | 120% |
| C 7-60 mg | 6.13 | 0.4022 | 0.105 | 3.83 | 177% |
| Acetyl | | | | | |
| C 5-30 mg | 8.10 | 0.5406 | 0.215 | 2.51 | 116% |
| C 5-45 mg | 7.42 | 0.4409 | 0.138 | 3.19 | 147% |
| C 5-45 mg | 6.69 | 0.4068 | 0.100 | 4.07 | 188% |

The data of Table 1, as expected, does not appear to differentiate between C7 and C5 resins. The percent increase of nicotine to propylene glycol as a percentage of the control ratio reaches a high of approximately 180%. This indicates that the smoke condensate to resin interaction is akin to the HPLC column. Nicotine is subtly excluded from binding to the functional groups of C5 and C7 present on the "cigarette column."

EXAMPLE 3

In the present example, the nonspecific entrapment of the smoke condensate was further reduced by using a more open resin with a bead size of 200 $\mu$m. In Table 2, the distributions of nicotine in the three compartments of the Cambridge filter, cigarette acetate filter and the recovered resin are shown.

TABLE 2

DISTRIBUTION OF NICOTINE

| Resin Type | Nicotine from Cambridge Filter Pad | Nicotine from Acetate Cigarette Fiber | Nicotine from Resin | Total Nicotine Recovered in mg |
|---|---|---|---|---|
| Control | 0.9167 | 0.6918 | n/a | 1.64 |
| Silica - 50 mg | 0.8148 | 0.4386 | 0.1195 | 1.37 |
| Silica - 150 mg | 0.7765 | 0.3383 | 0.2584 | 1.37 |
| Amino - 50 mg | 0.8913 | 0.4766 | 0.1059 | 1.47 |
| Amino - 150 mg | 0.8521 | 0.3768 | 0.3498 | 1.58 |
| C5 - 50 mg | 0.9090 | 0.5246 | 0.1012 | 1.54 |
| C5 - 150 mg | 0.8324 | 0.4316 | 0.3031 | 1.57 |
| Phenyl - 50 mg | 0.8888 | 0.4844 | 0.0658 | 1.44 |
| Phenyl - 150 mg | 0.9148 | 0.4541 | 0.2669 | 1.64 |

As shown in Table 2, due to the large bead size of the resins, nicotine on the Cambridge filters did not diminish greatly even when the resin input was150 mg. The total nicotine recovered in each experiment is the sum total of all three compartments. The upper limit (1.64 mg) is shown in the control experiment. In all the resin experiments, the total nicotine recovered approaches this value except for silica. This is due, in part, to incomplete resins' recovery, but is largely due to inadequate extraction of nicotine from the silica by the isopropanol.

The recovery result of nicotine from the monoacetate fiber filter is most interesting. This conventional filter is a passive diffusion and capture device permitting certain population of smoke micelles to pass. The resin column at the level of 150 mg input is 0.5 cm long segregating the tobacco rod from the acetate filter. Since the resin column precedes the acetate filter, it has the first right to take up smoke micelles which would have been available to the monoacetate filter. The resins are 200 $\mu$m, with 60 Å pore size, and a theoretically calculated 92 $\mu$m inter-bead spacing. Statistically the resin would favor the uptake of the larger size micelle population. The removal of this population of smoke condensate reflects the observed lower recovery of nicotine in all the acetate filters of the resin treated cigarettes than the control. The decrease actually is quite significant and ranges from a low of 35% to a high of 51%. This creates an apparent paradox because nicotine content of the Cambridge filter fraction is almost unaffected as compared to the control. Accordingly, at the resin level, it must be replenishing the nicotine flight to the Cambridge filter with reprocessed micelles that are able to escape the acetate filter entrapment. Specifically, the resin is apparently behaving as a dynamic exchanger and functioning like an HPLC column in chromatographing nicotine with the mobile phase as the smoke condensate. This example illustrates the multidimensional physical-chemical dynamics of the filtration process of the invention in contrast to convention physical entrapment technologies.

Table 3 illustrates the comparative selectivity of the functional groups in the porous resin (200 $\mu$m and 60 Å). It shows the differential retention by the resins of propylene glycol and not for nicotine.

TABLE 3

DIFFERENTIAL REMOVAL OF PROPYLENE GLYCOL AND NICOTINE BY RESIN

| | % Control | | | % Reduction | | |
|---|---|---|---|---|---|---|
| Resin Type | Nicotine | Propylene Glycol | Tar | Nicotine | Propylene Glycol | Tar |
| Silica - 50 mg | 88.9 | 55.4 | 89.5 | 11.1 | 44.6 | 10.5 |
| Silica - 150 mg | 84.7 | 41.4 | 83.2 | 15.3 | 58.6 | 16.8 |
| Amino - 50 mg | 97.2 | 63.4 | 97.2 | 2.8 | 36.6 | 2.8 |
| Amino - 150 mg | 93.0 | 39.4 | 87.4 | 7.0 | 60.6 | 12.6 |
| C5 - 50 mg | 99.2 | 80.2 | 102.8 | 0.8 | 19.8 | −2.8 |
| C5 - 150 mg | 90.8 | 51.9 | 92.3 | 9.2 | 48.1 | 7.7 |
| Phenyl - 50 mg | 96.9 | 64.2 | 92.3 | 3.1 | 35.8 | 7.7 |
| Phenyl - 150 mg | 99.8 | 54.3 | 92.3 | 0.2 | 45.7 | 7.7 |

Table 3 again demonstrates the differential removal of nicotine and propylene glycol in this very porous resin. The low percentage nicotine reduction makes it easy to contrast the over 50% reduction of propylene glycol. The carbon backbone of propylene glycol is C3, and this apparently accounts for its retention by the C5 resin. The phenyl ring as a rigid planar structure viewed from its side, is actually four carbons long. Together with the amino-propyl arm, the phenyl resin may actually behave like a C7 resin. This also accounts for its selectivity towards the propylene glycol. The 3-amino-propyl resin appears to have a two fold interaction with propylene glycol. The first is the propyl group of the resin with the propylene backbone. Then the resin amino group can hydrogen bond with the glycol-OH. Amino HPLC column is selective for carbohydrates and involves hydrogen bonding between N--H and the cis glycol O--H of carbohydrates. The duality of interactions suggests that the amino resin may show a slight advantage towards propylene glycol in comparison to the C5 and phenyl-resin. Table 4 summarizes the results of the specificity index comparisons.

TABLE 4

AMINO RESIN SELECTIVITY

| Particle Size | Resin | Nicotine/Propylene Glycol Ratio | Specificity Index % of Control |
|---|---|---|---|
| 200 μm | Control | 0.977 | 100% |
| 200 μm | C5 - 50 mg | 1.208 | 124% |
| | C5 - 150 mg | 1.711 | 175% |
| 200 μm | Phenyl - 50 mg | 1.476 | 151% |
| | Phenyl- 150 mg | 1.797 | 184% |
| 200 μm | Amino - 50 mg | 1.498 | 153% |
| | Amino - 150 mg | 2.30 | 235% |
| 50 μm | Control | 1.87 | 100% |
| 50 μm | Amino - 20 mg | 2.69 | 144% |
| | Amino - 40 mg | 3.60 | 193% |
| | Amino - 60 mg | 3.87 | 207% |
| | Amino - 80 mg | 3.72 | 199% |
| | Amino - 100 mg | 4.44 | 237% |

Table 4 shows the comparison of specificity index for amino resins of two particle sizes to that of C5 and Phenyl resins. The nicotine and propylene glycol are both extracted from the Cambridge filter pads. Additional comparison data seen in Table 6 firmly establish higher selectivity of the amino resin towards propylene glycol.

Finally, the selectivity of the phenyl resin was investigated by comparing the volatile and semi-volatile major aromatic components of the cold trap collected smoke condensate such as benzene, toluene and phenol. The semi-volatiles in the cigarette smoke were collected in cold traps (−76° C.) and analyzed by DB624 capillary column with FID detection in a gas chromatograph. Table 5 summarizes the comparisons and demonstrates the selectivity of the phenyl resin towards both benzene and toluene. It also illustrates the selectivity of the amino resin for phenol. Phenol or hydroxy-benzene is weakly acidic in an aqueous laden smoke condensate and therefore may form an ionic interaction with the weak basic amino resin. This explains the selectivity seen in Table 5 of phenol by the amino resin.

TABLE 5

PHENYL - RESIN SELECTIVITY

| Resin Type | Benzene % Reduction | Toluene % Reduction | Phenol % Reduction |
|---|---|---|---|
| Amino-150 mg | 43% | 70% | 78% |
| Amino-150 mg | 43% | 52% | 74% |
| Phenyl-150 mg | 68% | 88% | 64% |
| Phenyl-150 mg | 53% | 79% | 59% |
| C5-150 mg | 51% | 76% | 56% |
| Silica-150 mg | 38% | 56% | 60% |

All of the above data documents that "Affinity Smoke Chemistry" is valid and that the smoke components obey the principles governing the reverse phase column chromatography. This finding presents unique opportunities for the removal, or at least a reduction in, the level of all unwanted deleterious smoke components from the mainstream smoke of a cigarette.

EXAMPLE 4

The main constraint of smoke chromatography is the flow rate of the puff passing through the resin column. Total flow under the FTC condition is 35 ml per 2 seconds; thus the flow rate is 1.05 liters per minute. The linear velocity of the flow over a 0.5 cm resin column is 2.1 liters/cm/min. This flow rate hitherto is very foreign to any conditions of chromatography, and the resin needs some special treatment to increase the probability of successful encounters between the smoke components and the functional groups. One parameter that directly relates to specificity is the density of functional groups on the resin. When smoke components are accelerating at such a high velocity, the abundance of functional groups may encourage more frequent collision, meandering, probing and testing to result in only high affinity binding. Density of functional group loading in the resin is noted as its capacity. Table 6 examines the resin capacity as a function of the specificity index for nicotine and propylene glycol.

TABLE 6

SPECIFICITY AS A FUNCTION OF CAPACITY

| Approx. Particle Size | Capacity milliequivalent per Gm resin | Resin Type | Specificity Index (% of Control Ratio NiC/PG) |
|---|---|---|---|
| | | Control | 100% |
| Fiber | Low | 40 mg Glass Fiber, C-5 | 110% |
| | | 60 mg, Glass Fiber, C-5 | 100% |
| 50 μm | ~0.1 meq | 75 mg, Bead C-18 | 122% |
| | | 100 mg, Bead C-18 | 130% |
| | | 100 mg, Bead C-18 | 124% |

TABLE 6-continued

SPECIFICITY AS A FUNCTION OF CAPACITY

| Approx. Particle Size | Capacity milliequivalent per Gm resin | Resin Type | Specificity Index (% of Control Ratio NiC/PG) |
|---|---|---|---|
| 60 μm | 0.5 meq | 100 mg Bead, $NH_2$ | 183% |
| | | 130 mg, Bead $NH_2$ | 197% |
| | | 100 mg, Bead C-5 | 168% |
| | | 130 mg, Bead C-5 | 164% |
| 100 μm | 0.6 meq | 50 mg, Bead $NH_2$ | 203% |
| | | 50 mg, Bead $NH_2$ | 195% |
| | | 45 mg, Bead C-5 | 147% |
| | | 45 mg, Bead C-5 | 188% |
| 200 μm | 0.8 meq | 50 mg, Bead $NH_2$ | 153% |
| | | 150 mg, Bead $NH_2$ | 235% |
| | | 50 mg, Bead C-5 | 124% |
| | | 150 mg, Bead C-5 | 175% |
| 40 μm | 1.0 meq | 60 mg, Bead $NH_2$ | 207% |
| | | 80 mg, Bead $NH_2$ | 199% |
| | | 100 mg, Bead $NH_2$ | 237% |

As Table 6 illustrates, the higher the capacity, the better the specificity. At the low end when glass fibers are derivitized, the capacity is too low to measure and its specificity index is not very different from the control. The specificity factor increases dramatically when the capacity reaches 0.5 to 0.6 milliequivalent per gram resin. At 0.8 meq./gm to 1.0 meq/gm resin, it is at the maximum value. The selectivity of the amino resin follows the same trend when compared to resin capacity. Indeed the difference in specificity index between the amino and C-5 resins at the lower capacity of 0.5 meq is 20%, however, at 0.8 meq, the specificity indexes of the two resins now differ by 50%. This is consistent with the supposition that the higher the capacity, the easier it is to attain specificity.

The chromatography of smoke components on the resin is limited in time and space. Even at the optimum, the first and the last puff are less specific. When the smoke micelles of the first puff reach the resin surface, there is no competition and all components regardless of affinity can occupy a site on the resin. The last puff is equivalent to the final mobile phase load to the resin column with no additional washing. Each cigarette smoked according to the FTC method has a total of six to seven puffs. When the efficiency of the resin column is at its best, there is still roughly a minimum of 2/7 puffs or 30% error. Experimentally, this was investigated by extracting the resin after a smoking session and studying the specificity of binding for the intended design of the column. Table 7 examines the bound nicotine and propylene glycol (p.g.) on the amino resins.

TABLE 7

PARTICLE SIZE VS SELECTIVITY

| Approx. Particle Size | | μg/mg resin Nicotine | μg/mg resin Propylene Glycol | Ratio Nic/PG |
|---|---|---|---|---|
| 60 μm | 30 mg | 14.52 | 12.52 | 1.16 |
| | 40 mg | 14.99 | 14.48 | 1.04 |
| | 50 mg | 12.99 | 10.18 | 1.27 |
| | 60 mg | 12.01 | 9.22 | 1.30 |
| | 80 mg | 9.31 | 6.53 | 1.43 |
| | 100 mg | 7.24 | 4.55 | 1.59 |
| 100 μm | 70 mg | 5.50 | 8.83 | 0.62 |
| | 100 mg | 4.89 | 7.15 | 0.68 |
| | 130 mg | 3.47 | 4.89 | 0.71 |

TABLE 7-continued

PARTICLE SIZE VS SELECTIVITY

| Approx. Particle Size | | μg/mg resin Nicotine | μg/mg resin Propylene Glycol | Ratio Nic/PG |
|---|---|---|---|---|
| 200 μm | 50 mg* | 2.12 | 6.24 | 0.34 |
| | 150 mg* | 2.33 | 4.81 | 0.48 |

*Assuming total recovery

As Table 7 illustrates, the resin design selects propylene glycol and excludes nicotine. The ratio of nicotine to propylene glycol equal to 0.34 is found in the last row of the table in the 50 mg resin experiment. This ratio indicates high selectivity for propylene glycol and it approaches the theoretical error limit as previously discussed. Ultimately, the superiority of the resin is only recognized for its outcome at the level of the Cambridge filter. In Table 6, the specificity index of this 200 μm, 50 mg resin is 153%. To put this into perspective, the 50 mg resin column faces the most stringent of puffing competition and therefore those molecules that survive the test are very specific. However, because of the length and volume of the resin column, its overall performance is at a disadvantage. When the resin column is increased to 150 mg, the ratio of bound nicotine/p.g. (Table 7) drops to 0.48. However, there is an overwhelming increase in column performance as measured by the specificity index of 235% (Table 6).

The ratio of nicotine/propylene glycol data of Table 7 classifies the resins as a function to particle size roughly into two classes; the 60 μm resins are not specific while the 100 and 200 μm resin columns are more specific. This correlation to particle size can be explained in terms of nonspecific entrapment by the small particle size resins which act like a physical filter. Whereas, with the large particles, the molecules are free to collide, explore, and thus result in specific binding.

EXAMPLE 5

Figure 1B:
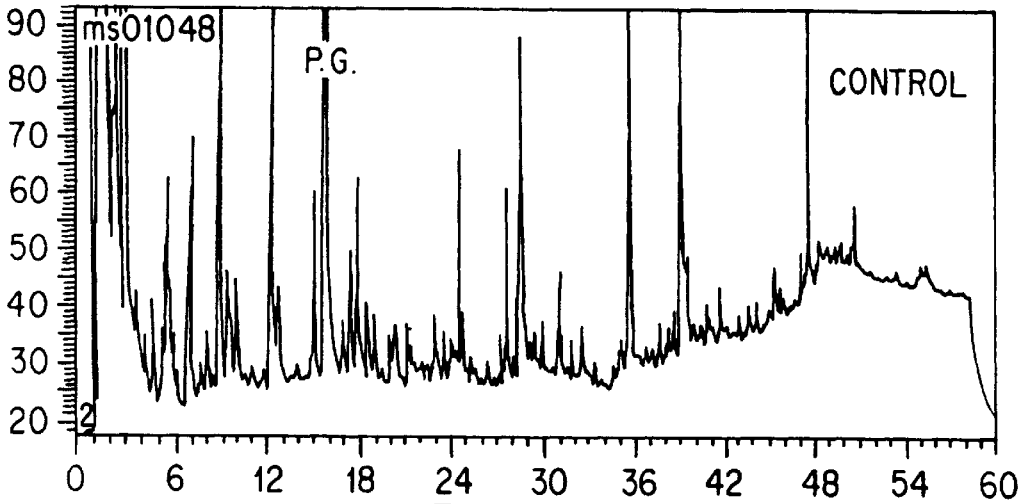
Figure 1C:
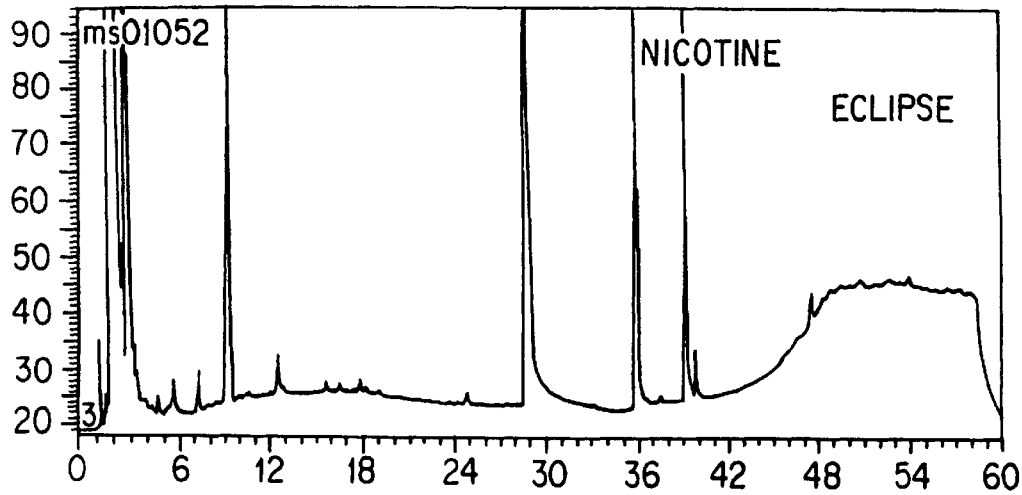

A practical application of the affinity smoke chemistry is to test a C-18 resin of high porosity and particle size of 100–200 μm. The C-18 resin is the most popular reverse phase media in HPLC chromatography because the long aliphatic side-chain has the broadest selectivity. It is a "catch-all" resin. Conversely, many polar flavor molecules of alcohol and aldehyde and some flavor molecules including nicotine show weak interactions with the C-18 resin. Again the resins were placed behind the tobacco rod in tandem and kept in place by a thin layer of glass wool. A hollow acetate filter of 0.5 cm in length was removed from an Eclipse cigarette and used to support the glass wool which indirectly prevented the resin from shifting. Similarly, two hollow acetate filters were used to support the control cigarette as it was tested in the smoking machine. FIG. 1 shows the comparative GC evaluations of the vapor-phase smoke collected in methanol traps of: the resin treated cigarettes, the control cigarettes and the full flavored Eclipse cigarettes. FIG. 1 middle panel, the control chromatogram illustrates many volatile and semivolatile smoke components. A total of about 100 vapor phase smoke components of a burning cigarette have been described in the monograph of "Chemical and Biological Studies On New Cigarette Prototypes That Heat Instead of Burn Tobacco" (R. J. Reynolds Tobacco Company, 1988). Several components in the chromatogram have been assigned identity and these are:

benzene at 7.43 mins, internal standard (I.S.) methylcyclohexane at 9.48 mins., toluene at 12.76 mins., propylene glycol at 17.2 mins., phenol at 28.8 mins., glycerol at 30.3 mins., quinoline(I.S.) at 36.0 mins. and nicotine at 39.32 mins. The Eclipse vapor phase chromatogram (bottom panel) in comparison to the unfiltered control cigarette is very simple. The most prominent species are: nicotine, glycerol, toluene, and benzene. However, many other smoke components between toluene and glycerol are clearly visible. Also observed are the volatiles that appear at the beginning of the chromatogram, before the benzene peak at 7.4 minutes. At the end of the chromatogram between 45–57 minutes a large number of low level components are indicated. The simple and clean vapor phase chromatogram of Eclipse is therefore a standard for purity of cigarette smoke.

In FIG. 1, top panel, the vapor phase chromatogram of the C-18 puff affinity resin treated cigarette is shown. The resin composition consists of: 50 mg silica (100 μm and 60 Å), 100 mg C-18 resin (100 μm and 60 Å) 100 mg C-18 resin (200 μm and 60 Å) and 100 mg 3 aminopropyl resin (200 μm and 60 Å), and thus contains silica, C-18 and amino functionalities. From a visual examination of the chromatogram, it is readily apparent that the resin treated vapor phase is also relatively simple and clean. In particular, the multitude of semivolatiles and volatiles appearing between the I.S. (methyl-cyclohexane) and glycerol as seen in the control chromatogram are all absent, except for propylene glycol and a trace of toluene and phenol. The resins also have significantly decreased the highly retentive components which are eluted after 54 minutes. There are a few volatile species including benzene at the beginning of the chromatogram. At room temperature these components are very volatile and a small amount may even come off the resin during the smoking session and be retained in the cold trap. In contrast, there is a significant amount of nicotine still present in the smoke even after passage through such a broad spectrum specificity resin.

Figure 2A:
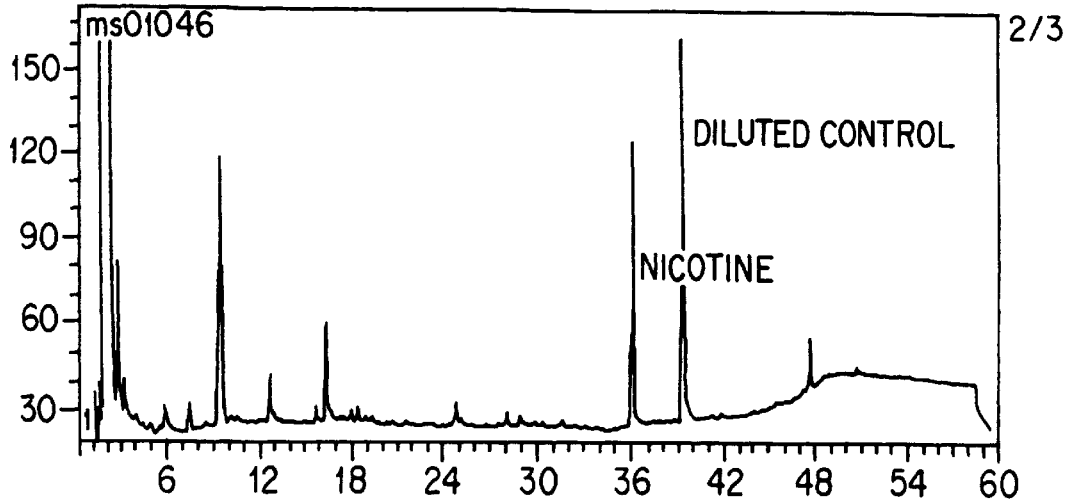
Figure 2B:
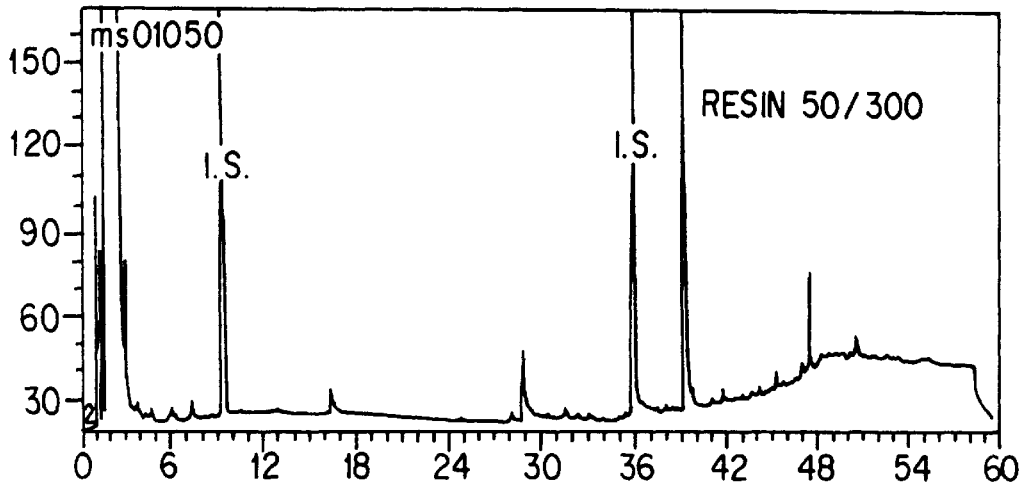
Figure 2C:
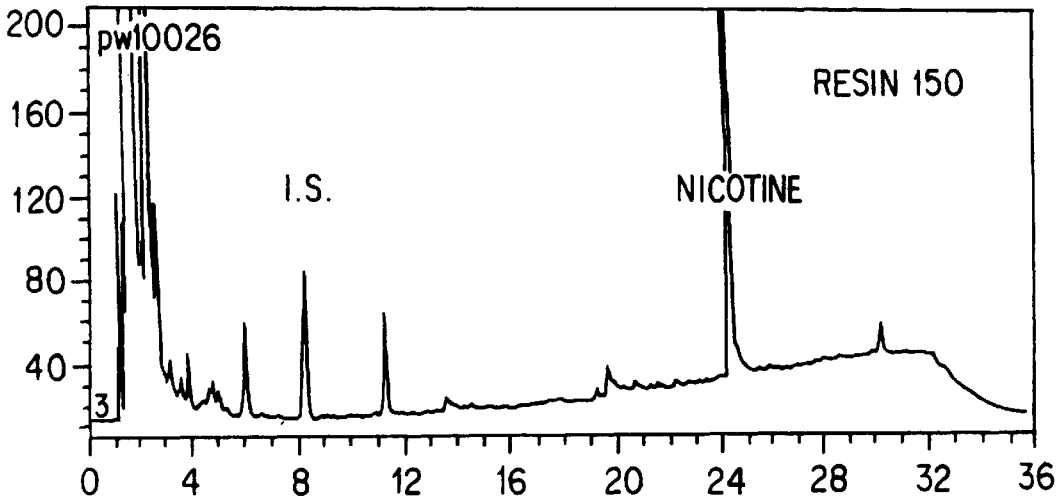

FIG. 2 (middle panel) shows the vapor phase chromatogram of the combination resin consisting of: 50 mg 3 aminopropyl resin (100 μm and 60 Å) and 300 mg of C-18 resin (100 μm and 60 Å). The total areas of all the vapor phase components were summed and compared to the total integrated areas of the control (FIG. 1, middle panel). The relative areas of the resin treated smoke components were 19.7% of the control integrated areas. Therefore, the control methanol trap vapor phase content was diluted 1:4 and then subjected to GC analysis. The resultant chromatogram (FIG. 2 top panel) is compared to the resin treated GC vapor phase chromatogram. The diluted control serves as a barometer in determining the efficient removal of any smoke component by the C-18 resin. The resin vapor phase profile should resemble the 1:4 diluted control chromatogram, if all smoke components is removed proportionately and non-specifically. Obviously, this is not the case, as the following smoke components of known identity illustrate. The most prominent component is nicotine and it is enhanced by two fold; the resin treated nicotine content is 0.4 mg whereas the 1:4 diluted control is 0.2 mg. Glycerol is even removed less by the C-18 resin and it is four and half times more than the diluted control. By contrast, the removal of toluene and propylene glycol are nearly complete. They are respectively: 7.6% and 22.7% that of the 1:4 diluted control. Benzene is relatively neutral, in that the resin treated content is 75% of the diluted control. Phenol in the resin treated is 51% that of the diluted control. These quantitative comparsion results illustrate that the C-18 and the amino resins are actively removing smoke components on the basis of structural and chemical characteristics. By design, nicotine and other flavor smoke components that possess a positive charge, or which are very polar, are deferentially less removed by the resins. Hence, many of the tobacco specific alkolides such as nornicotine, anatabine, and anabasin will also be differentiated by the C-18 resin. Their exact locations have not been assigned, however, they should reside near quinolin and nicotine. Indeed, several candidate species are clearly visible between 32–46 minutes which like nicotine appear to be significantly less removed than the 1:4 diluted control. As revealed in FIG. 3, the flavor components of menthol and vanillin are eluted in this region of the chromatogram. In provisional taste tests by a knowledgeable smoker, the resin treated cigarette is still flavorful.

The chromatograms of FIG. 1 top and bottom panels further illustrate that the C-18 resin vapor phase is comparable both in simplicity and in the total amount of components to that of the Eclipse. This experiment affirms the uniqueness of the affinity resin technology. The implication is that the cigarette smoke is also safe. This is not surprising since both PAH and nitrosoamines are highly retentive on the C-18 resin in HPLC chromatography. The total tar of the resin treated cigarette as evaluated by spectrophotometry is also decidedly low, only at about 3.5–4.0 mg. The nicotine content is between 0.3–0.4 mg which is about 3–4 times more than the full flavored Eclipse of 0.1 mg.

Similar results were obtained with different combination resins incorporating several large and small particle size resins of 100–200 μm. The capacity of the 100 μm and 200 μm resins were both 0.8 milli-equivalents of C-18 loading per gm of silica. The pressure drops of these resins were measured and shown in Table 8.

TABLE 8

PRESSURE DROP MEASUREMENTS

| Resin or Filter | Pressure drop |
|---|---|
| Monoacetate Filter 20 mm | 2% |
| 300 mg 200 μm | 3% |
| Resin 50/300 (50 mg 100 μm 300 mg 200 μm) | 4% |
| Resin A (135 mg 100 μm 200 mg 200 μm) | 5% |
| 150 mg 100 um | 6% |
| 200 mg 100 um | 7% |
| Resin S0 (150 mg 100 μm 200 mg 200 μm) | 8% |
| Resin S08 (150 mg 100 μm 200 mg 200 μm) | 8% |

The low tar delivery of the resin treated cigarette is not a result of non-specific physical trapping or to a high pressure drop. The 1:4 dilution of control smoke experiment clearly shows that it is due to differential binding. Further, the potential of this technology to produce different marketable cleaner cigarettes is illustrated in FIG. 2. As FIG. 2 (bottom panel) shows, a 150 mg of 100 μm C-18 resin treated cigarette produces a vapor phase GC chromatogram comparable to that of the diluted control, differing primarily in that the nicotine content is almost doubled at 0.8 mg and the tar content is 14 mg. This is equivalent to a full flavored low tar cigarette, except that it has a much cleaner vapor phase smoke. For the 50/300 resin treated cigarette (middle panel), the nicotine content is 0.4 mg. It is equivalent to an ultra low tar cigarette with a higher than normal nicotine and flavor content. These experiments demonstrate the range of cigarette products that can be manufactured by simply adjusting the amount of C-18 resins in the filter.

EXAMPLE 6

Figure 3:
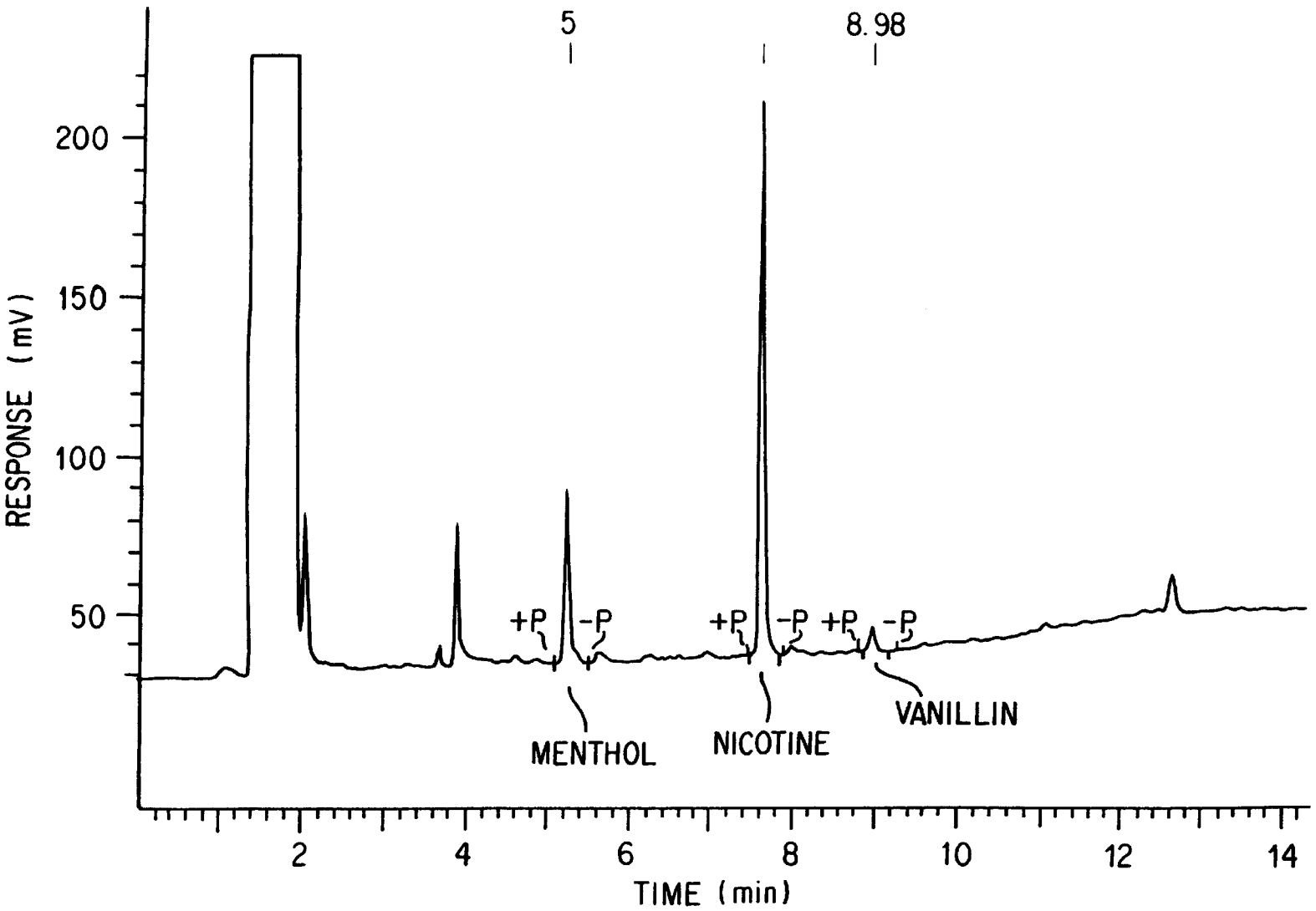

The displacement of nicotine by other strong binding smoke components in the puff affinity resin has been illustrated in many of the above experiments. These results suggest that extrinsic flavor can be delivered by a flavor cartridge to the smoker. The flavor can be delivered in large doses or made to release slowly. In the experiment, 50 mg of C-1 resin was loaded by melting 4.2 mg of menthol and 9.6 mg of vanillin in-situ. The resins were carefully placed behind the tobacco rod of a Marlboro cigarette as in the above experiments. The flavor cartridge immediately transformed the full flavored cigarette into a menthol cigarette. FIG. 3 shows the mainstream smoke GC chromatogram of the smoke trapped on a Cambridge filter and extracted by 2-propanol. The menthol delivered is 1.19 mg or 28.2% of the input, however, only a small percentage of vanillin is delivered. This shows the selectivity of the resin binding towards vanillin and not menthol. For vanillin delivery, another bonded phase resin would have to be selected or empirically determined. The menthol delivered by the affinity technology is a controlled release. The flavor is released in each puff; from the first to the last puff. In the monoacetate loaded menthol, the flavor is chronically released because there is no chemical binding. The delivery is most abundant in the first puff and then quickly diminishes with every puff such that in the last few puffs, there is no menthol.

In a limited number of experiments, the loading and delivery of menthol has been further investigated. By melting the menthol in-situ on a smaller cartridge of 30 mg, the percentage delivery was increased to 34.4%. When the menthol was loaded in alcohol and dried by vacuum evaporation, only 4% of the loaded menthol was found on the Cambridge filter. This indicated that most of the menthol was not available for the smoke micelles to displace. Presumably, the menthol must have been lodged in the interior of the resin where the pores of 0.6 $\mu$m were limited in accessibility to the smoke micelles of 0.1–1.0 $\mu$m. This further suggests that all the affinity experiments thus far are a surface phenomenon. A resin with much larger pores, such as a 5 $\mu$m pore size may be used by making available additional interior resin surface.

A low tar menthol cigarette can also be manufactured by adding the menthol cartridge to the C-18 affinity resin. When the flavor cartridge preceded the C-18 affinity resin cartridge, most of the menthol was removed by the C-18 resin. By placing the flavor cartridge (30 mg C-1 resin) behind the C-18 affinity resin, 18.25% of the menthol now become available. The decrease of menthol delivery from 34.4% to 18.25% may reflect the importance of moisture when the resins were located next to the tobacco rod versus far away from it.

The examples provided above are illustrative of the present invention and numerous modifications will be apparent to the skilled artisan. Accordingly, the present invention is not intended to be limited by the foregoing examples, but rather, is defined by the claims which follow and their equivalents.

What is claimed is:

1. A smoking article capable of delivering a regulated smoke composition to a smoker, comprising:

a) a combustible filler wrapped in a combustible sheath; and b) at least one affinity chromatographic filter unit designed to preferentially remove specific targeted components from said smoke disposed within said sheath adjacent said combustible filler, said filter unit consisting essentially of a mass of silica or resin particles having chemically bonded to their surfaces functional groups which exhibit preferential affinity for said targeted components and which reversibly bind said targeted components to elute components having a lower affinity than a previously bound component.

2. A smoking article as recited in claim 1, wherein said particles are selected from the group consisting of silica, methacrylate, styrene and styrene divinylbenzene.

3. A smoking article as recited in claim 2, wherein said particles are porous silica beads.

4. A smoking article as recited in claim 3, wherein said particles have an average diameter of from about 35 to about 400 microns.

5. A smoking article as recited in claim 4, wherein said particles have an average diameter of from about 75 to about 200 microns.

6. A smoking article as recited in claim 5, wherein said pores have an average diameter of from about 60 to about 1000 angstroms.

7. A smoking article as recited in claim 6, wherein said pores have an average diameter of from about 300 to about 1000 angstroms.

8. A smoking article as recited in claim 7, wherein said functional groups have the general formula:

$$R^1(CH_2)_n—$$

wherein:

n is an integer from 1 to 40; and $R^1$ is hydrogen, hydroxy, amine, amide, cyano, nitrile, nitro, thio, sulfide, sulfone, sulfoxide, I, Br, Cl, F, or an alkyl or aryl group of from 1 to 40 carbon atoms which is optionally substituted with one or more atoms selected from the group consisting of O, N, S, I, Br, Cl and F.

9. A smoking article as recited in claim 8, wherein $R^1$ is hydrogen and n is an integer from 3 to 18.

10. A smoking article as recited in claim 9, wherein n is 18.

11. A smoking article as recited in claim 1, wherein said at least one filter unit comprises first and second filter units having silica or resin particles bearing different functional groups in each of said filter units.

12. A smoking article as recited in claim 1, further comprising a nonchromatographic filter unit consisting essentially of a mass of nonfunctionalized silica or resin particles disposed within said sheath and in flow communication with said chromatographic filter units.

13. A smoking article as recited in claim 12, wherein said nonfunctionalized silica or resin particles comprise porous silica beads having an average diameter of from about 35 to about 75 microns.

14. A smoking article as recited in claim 11, wherein said further comprising a nonchromatographic filter unit consisting essentially of a mass of nonfunctionalized porous silica beads having an average diameter of from about 35 to about 75 microns disposed within said sheath and in flow communication with said affinity chromatographic filter unit.

15. A smoking article as recited in claim 14, wherein said affinity chromatographic filter unit contains a sufficient amount of said functionalized silica or resin particles and said nonchromatographic filter unit contains a sufficient amount of said nonfunctionalized silica or resin particles to reduce the tar content of the smoke delivered to the smoker to from about 0.75 mg to about 1.25 mg.

16. A smoking article as recited in claim 15, wherein the nicotine content of the smoke delivered to the smoker is from about 0.1 mg to about 0.3 mg.

17. A smoking article as recited in claim 1, wherein said affinity chromatographic filter unit further comprises a flavoring compound bound to said functional groups such that they are displaced by said targeted components during smoking to provide a sustained delivery of flavoring.

18. A smoking article as recited in claim 17, wherein said flavoring is menthol and said ligand is an organic group of the formula:

$$—(CH_2)_n—$$

wherein:

n is an integer from 1 to 8.

19. A smoking article as recited in claim 1, wherein said functional groups are chemically bonded to said silica or resin particles by reaction of said silica or resin particles with a silane compound comprising said functional groups.

20. An affinity chromatographic filter cartridge for selectively removing one or more targeted components from cigarette smoke comprising a hollow sleeve packed with silica or resin particles bearing functional groups chemically attached thereto exhibiting greater affinity for said targeted components than for other components of said smoke and which reversibly bind said targeted components to elute components having a lower affinity than a previously bound component.

21. A filter cartridge as recited in claim 20, wherein said silica or resin particles are selected from the group consisting of silica, methacrylate, styrene and styrene divinylbenzene.

22. A filter cartridge as recited in claim 21, wherein said silica or resin particles are porous silica beads.

23. A filter cartridge as recited in claim 22, wherein said silica or resin particles have an average diameter of from about 35 to about 400 microns.

24. A filter cartridge as recited in claim 23, wherein said pores have an average diameter of from about 60 to about 1000 angstroms.

25. A filter cartridge as recited in claim 24, wherein said functional groups have the general formula:

$$R^1(CH_2)_n—$$

wherein:

n is an integer from 1 to 40; and $R^1$ is hydrogen, hydroxy, amine, amide, cyano, nitrile, nitro, thio, sulfide, sulfone, sulfoxide, I, Br, Cl, F, or an alkyl or aryl group of from 1 to 40 carbon atoms which is optionally substituted with one or more atoms selected from the group consisting of O, N, S, I, Br, Cl and F.

26. A filter cartridge as recited in claim 25, wherein n is an integer from 3 to 18 and $R^1$ is hydrogen.

27. A filter cartridge as recited in claim 26, wherein n is 18.

28. A filter cartridge as recited in claim 25, wherein $R^1$ is selected from the group consisting of benzyl, naphthyl and anthracene moieties.

29. An affinity chromatographic filtration process for the preferential removal of one or more targeted components from cigarette smoke, comprising passing said smoke through the affinity chromatographic filter cartridge of claim 20 to preferentially remove said targeted components.

30. A process as recited in claim 29, wherein said preferential affinity of said ligands results from differences in charge between said ligands and said targeted components.

31. A process as recited in claim 29, wherein said ligands are selected from organic groups of the formula:

$$R^1(CH_2)_n—$$

wherein:

n is an integer from 1 to 40; and $R^1$ is hydrogen, hydroxy, amine, amide, cyano, nitrile, nitro, thio, sulfide, sulfone, sulfoxide, I, Br, Cl, F, or an allyl or aryl group of from 1 to 40 carbon atoms which is optionally substituted with one or more atoms selected from the group consisting of O, N, S, I, Br, Cl and F.

32. A process as recited in claim 31, wherein said functionalized silica or resin particles proportionately reduce tar components of cigarette smoke more than nicotine.

33. A process as recited in claim 32, wherein n is an integer from 3 to 18 and $R^1$ is hydrogen.

34. A process as recited in claim 33, wherein n is 18.

35. A process as recited in claim 31, wherein $R^1$ is selected from the group consisting of benzyl, naphthyl and anthracene moieties.

36. A process as recited in claim 31, wherein $R^1$ is $NR^2_3{}^+$, with each $R^2$ individually selected from H, aryl, and alkyl groups of from 1 to 5 carbon atoms.

* * * * *